US009445185B2

(12) United States Patent
Brunner et al.

(10) Patent No.: US 9,445,185 B2
(45) Date of Patent: Sep. 13, 2016

(54) AUDIO LISTENING SYSTEM

(71) Applicant: Beats Electronics, LLC, Culver City, CA (US)

(72) Inventors: Robert Brunner, San Francisco, CA (US); Gregoire Vandenbussche, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/925,613

(22) Filed: Jun. 24, 2013

(65) Prior Publication Data

US 2014/0211976 A1 Jul. 31, 2014

Related U.S. Application Data

(63) Continuation-in-part of application No. 13/517,035, filed as application No. PCT/US2011/067045 on Dec. 22, 2011, now Pat. No. 9,084,055.

(60) Provisional application No. 61/429,426, filed on Jan. 3, 2011.

(51) Int. Cl.

| | |
|---|---|
| ***H04R 25/00*** | (2006.01) |
| ***H04R 1/10*** | (2006.01) |
| *H04R 5/033* | (2006.01) |

(52) U.S. Cl.

CPC ..... *H04R 1/1091* (2013.01); *H04R 1/1066* (2013.01); *H04R 1/1075* (2013.01); *H04R 5/0335* (2013.01)

(58) Field of Classification Search

CPC . H04R 1/1066; H04R 1/1008; H04R 1/1075

USPC ..... 381/371, 374, 379

See application file for complete search history.

(56) References Cited

U.S. PATENT DOCUMENTS

| | | | | |
|---|---|---|---|---|
| 3,454,964 A * | 7/1969 | Brinkhoff | A61F 11/14 | 2/209 |
| 4,027,113 A * | 5/1977 | Matsumoto | F16C 11/0661 | 381/370 |
| 4,965,836 A * | 10/1990 | Andre | H04R 1/1008 | 181/129 |
| 6,542,615 B1 * | 4/2003 | Ito | H04R 1/1066 | 381/370 |
| 6,724,906 B2 * | 4/2004 | Naksen | H04R 1/1066 | 381/370 |
| 8,774,420 B2 * | 7/2014 | Belafonte | H04R 1/2811 | 381/182 |

* cited by examiner

*Primary Examiner* — Curtis Kuntz
*Assistant Examiner* — Ryan Robinson
(74) *Attorney, Agent, or Firm* — Ganz Pollard LLC

(57) ABSTRACT

An audio listening device having a damped ball joint type interface between an ear-cup assembly and a headband assembly is provided. For example, the audio listening device can include a headband assembly comprising at least one end; an ear-cup assembly pivotably engaged to the at least one end of the headband assembly by an engagement structure, the engagement structure comprising at least two cooperatively coupled curved surfaces; and a damper rim coupled to the ear-cup assembly and to the at least one end of the headband assembly, wherein the damper rim is configured to at least partially constrict movement of the ear-cup assembly relative to the headband assembly.

20 Claims, 14 Drawing Sheets

AUDIO LISTENING SYSTEM

CROSS-REFERENCE TO RELATED APPLICATIONS

This application is a continuation-in-part of U.S. Non-provisional patent application Ser. No. 13/517,035, filed on Sep. 11, 2013, entitled "Audio Listening System," which is a national stage patent application of PCT/US11/67045, filed on Dec. 22, 2011, which claims priority from U.S. Provisional Patent Application No. 61/429,426, filed on Jan. 3, 2011, all of which are incorporated by reference herein in their entirety.

BACKGROUND OF THE INVENTION

The description that follows relates generally to headphones. In particular, the description relates to an improved audio listening system with improved earphone configurations.

Commercially available headphones typically comprise a pair of earphones, or ear-cups, coupled to one another by a resilient curved band, e.g., a headband, that applies sufficient force to the ear-cups to hold the headphones in place on the user's head. Ear-cups are designed to be positioned close to the auditory canal of the user's ear to create an acoustically necessary coupling space there between. If the ear-cup is not positioned squarely over the user's outer ear, the force holding the headphone in place may be concentrated on one part of the user's ear, causing the ear to become sore. Moreover, the uniqueness of each user's ear shape creates a problem for designing ear-cups that universally provide a comfortable and close fit to the outer part of the ear. Because today's users tend to wear headphones for relatively longer periods of time, the ability to completely and comfortably adjust a headphone to each particular user is becoming as important of a feature to consumers as the acoustical parameters of the headphone.

Many of today's headphone users also require greater portability from a headphone, as the combination of the Internet and smart phones have made music, video, and online applications available virtually anywhere and at anytime. Among commercially available headband type headphones, a few of them can be folded into a compact form when not in use, thereby protecting the headphones when not in use and increasing their portability. In addition, with greater mobility comes increased visibility, and so, for some users, headphones have become a form of artistic expression, making the aesthetic appeal of the headphone an important feature as well.

A common problem in many commercially-available headphones is the existence of a "rattling" sound within the ear-cups. In some instances, the rattling may be more prevalent when listening to audio files at high volume levels and/or when playing music with a rich bass. One cause of this rattling noise can be the dislodgement of internal components of the ear-cups, such as the diaphragm, wires, etc. Needless to say, the rattling noise can grossly interfere with the headphone user's enjoyment of the headphone.

SUMMARY OF THE INVENTION

The present disclosure is defined by the appended claims. This description summarizes some aspects of the embodiments and should not be used to limit the claims.

A technical advance is achieved by an audio listening device that includes ear-cups pivotably engaged to a headband assembly by engagement structures and a damper rim positioned between the ear-cups and the headband assembly, wherein the engagement structures and the damper rim provide semi-free, damped rotation of the ear-cups relative to the headband assembly.

According to one embodiment, an audio listening device includes a headband assembly comprising at least one end and an ear-cup assembly pivotably engaged to the at least one end of the headband assembly by an engagement structure. The engagement structure comprises at least two cooperatively-coupled curved surfaces. The audio listening device further includes a damper rim that is coupled to the ear-cup assembly and to the at least one end of the headband assembly. Moreover, the damper rim is configured to at least partially constrict movement of the ear-cup assembly relative to the headband assembly.

Other articles of manufacture, features, and advantages of the present invention will be, or will become, apparent to one having ordinary skill in the art upon examination of the following drawings and detailed description. It is intended that all such additional articles of manufacture, features, and advantages included within this description be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

Illustrative and exemplary embodiments of the invention are described in further detail below with reference to and in conjunction with the figures.

DETAILED DESCRIPTION

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the disclosure is intended to cover all such embodiments that may fall within the scope of the appended claims, either literally or under the doctrine of equivalents.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects.

Figure 1:
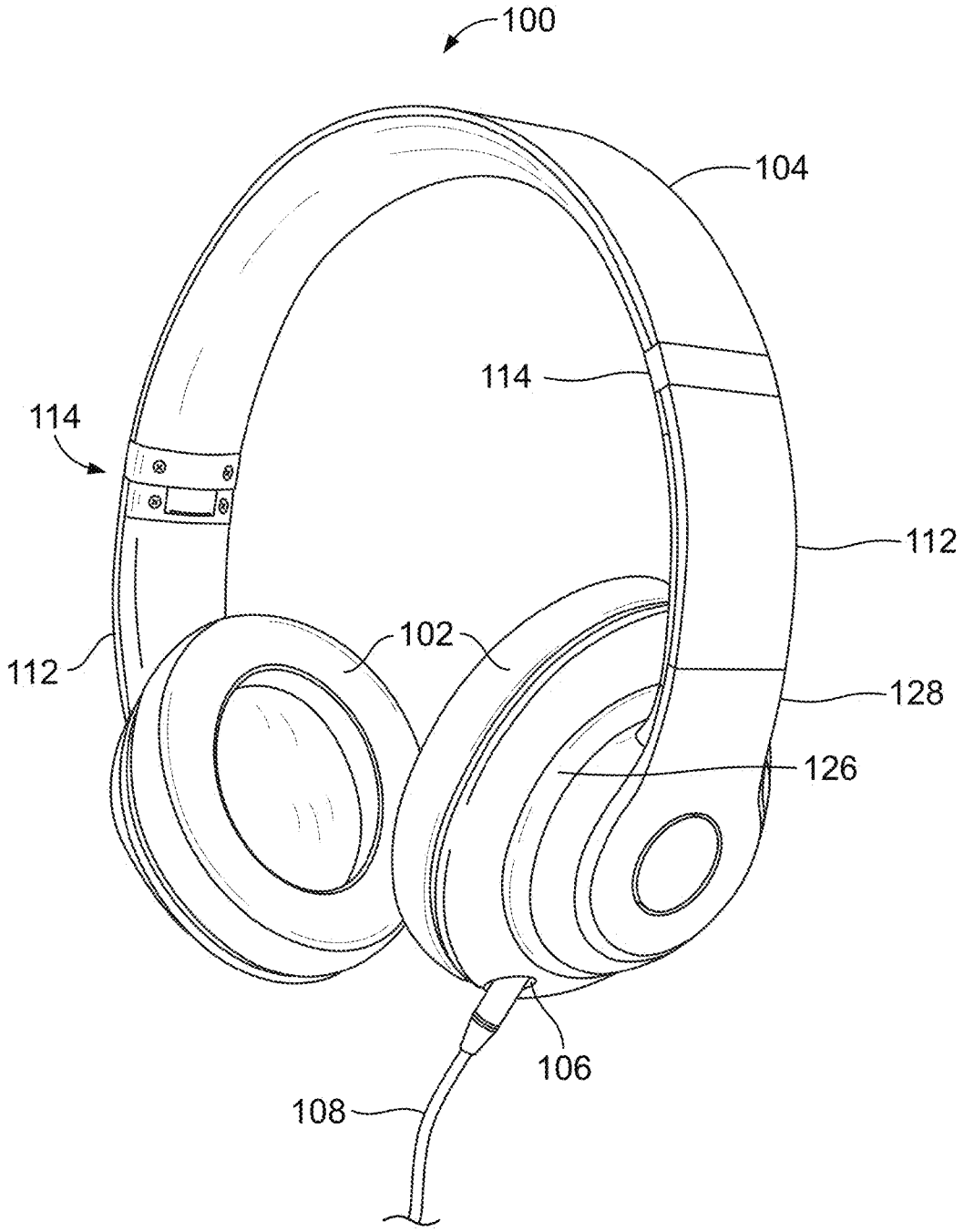
FIG. 1 is a diagram showing a perspective view of an embodiment of a headphone.

FIG. 1 illustrates an embodiment of an audio listening system, or headphone 100. The headphone 100 includes a pair of ear-cups 102 (also referred to herein as an ear-cup assembly) which are interconnected by the two ends of a substantially U-shaped or C-shaped, flexible or elastic, and resilient headband assembly 104. The headband assembly 104 has an adjustable curvature so as to be arranged along a portion of the head or neck of the user or wearer. In one embodiment, the headphone 100 is constructed from strong yet lightweight aluminum or plastic, which helps minimize vibrations, thereby minimizing unwanted audio artifacts. The headband also provides sufficient clamping force to reduce or prevent air from escaping around the ear-cups 102, thus increase lower frequency performance.

At least one of the ear-cups 102 includes a cable port 106. In practice, by plugging a headphone cable 108 into the cable port 106, the headphone wearer may use the headphone 100 to listen to audio signals being transmitted through the headphone cable 108. In one embodiment, each of the ear-cups 102 includes a cable port 106, and the cable ports 106 operate as input/output cable ports for inputting audio signals through one cable port 106 and outputting audio signals through the second cable port 106 to, for example, a second headphone set (not shown). Other mechanisms for transmitting signals to (and from) headphone 100 may be provided, such as alternative locations for cable port(s) 106 or the integration of wireless connectivity (such as, e.g., Bluetooth), without departing from the description herein.

Figure 2:
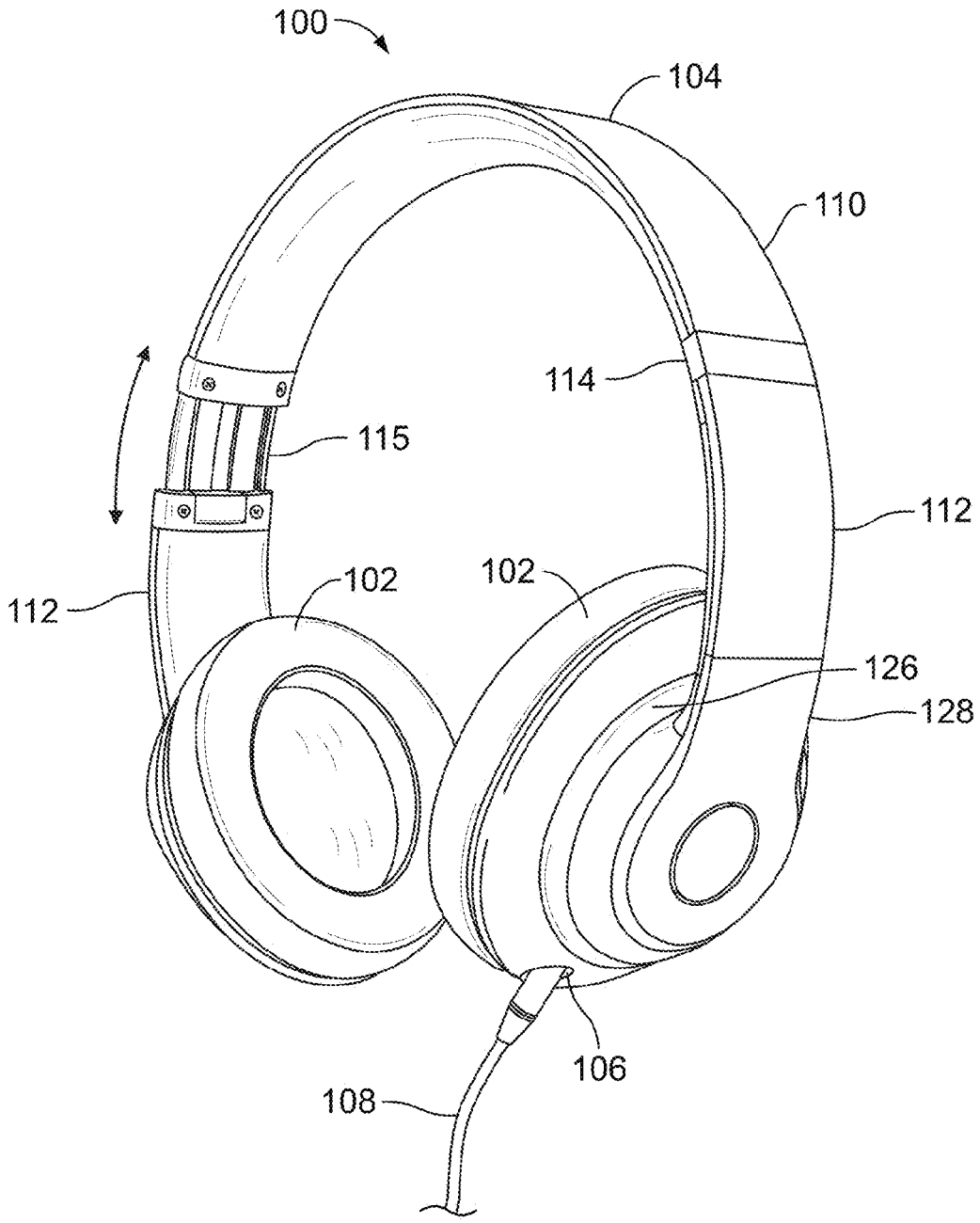
FIG. 2 is a diagram showing a perspective view of the headphone of FIG. 1 with one extended sliding member in accordance with one embodiment.
Figure 4:
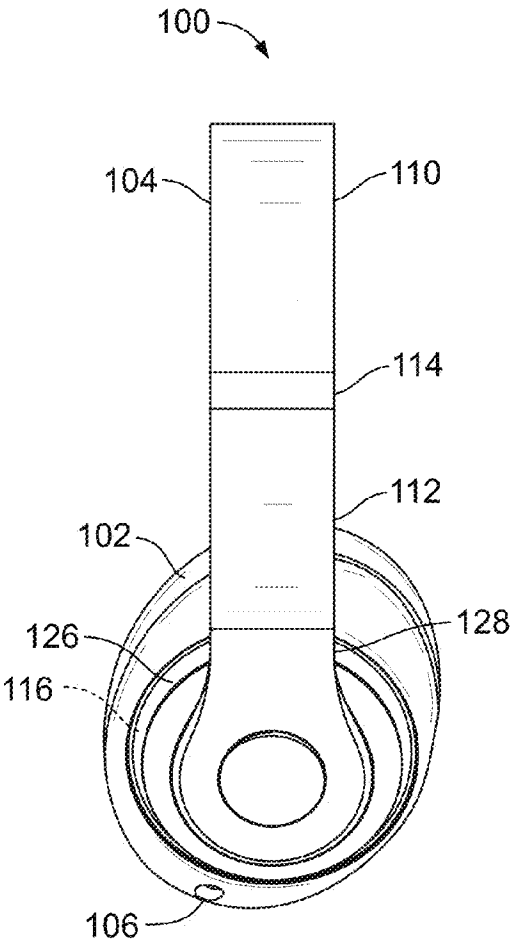
FIG. 4 is a diagram showing a side view of the headphone of FIG. 1.
Figure 3:
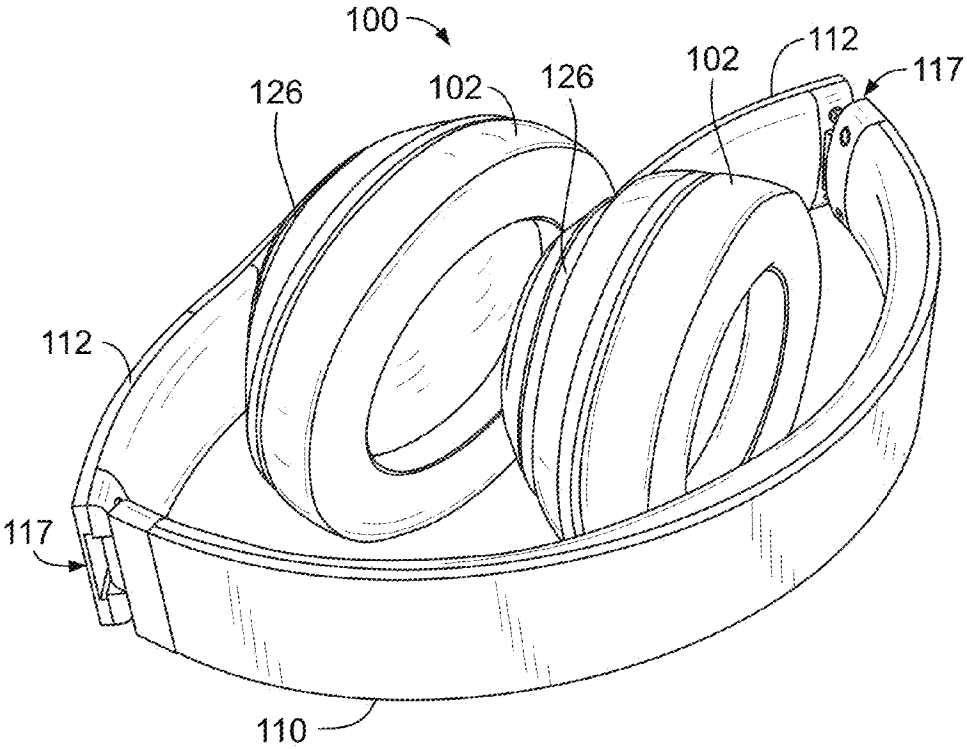
FIG. 3 is a diagram showing a perspective view of the headphone of FIG. 1 with the ear-cups folded in the space underneath the headband in accordance with one embodiment.
Figure 5:
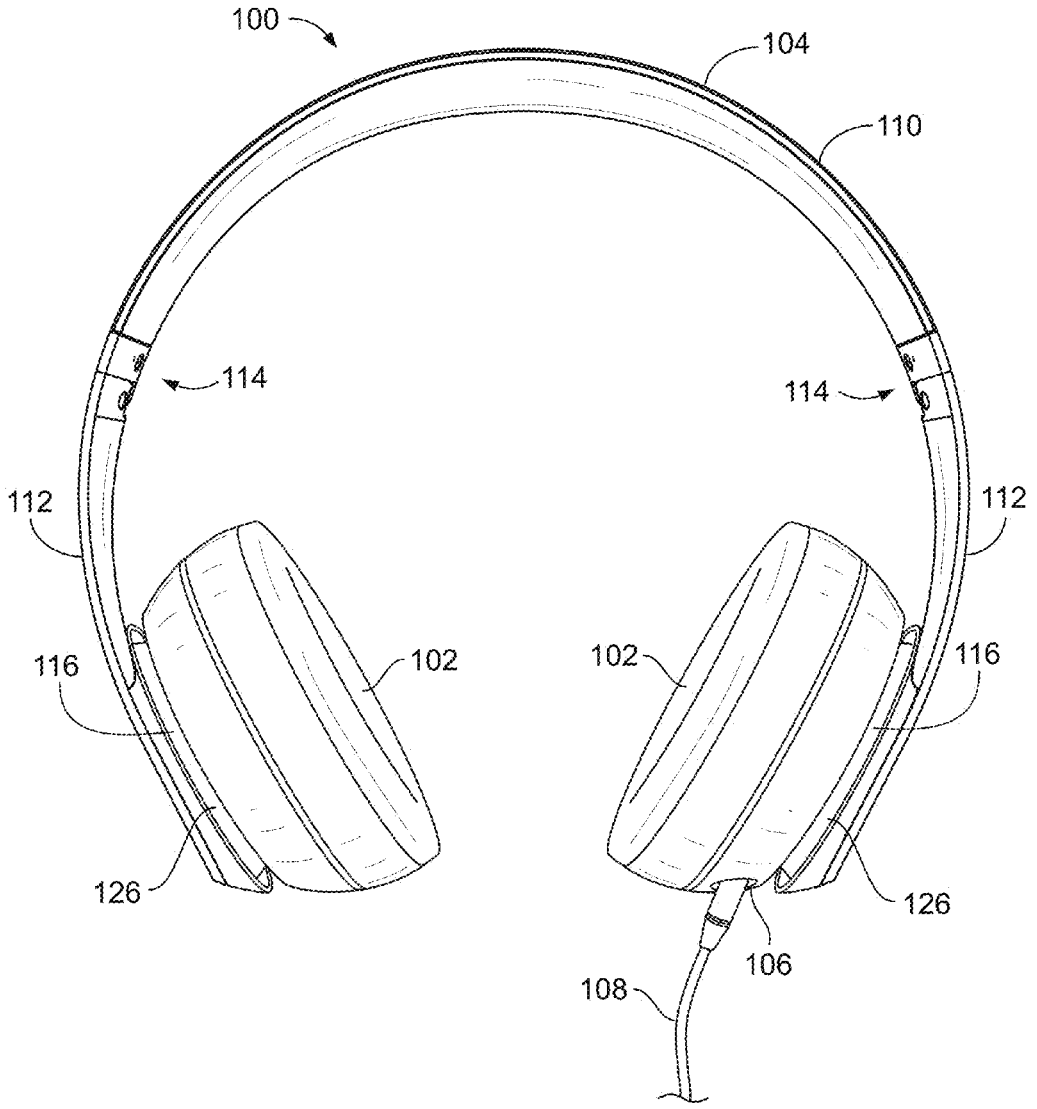
FIG. 5 is a diagram showing a front view of the headphone of FIG. 1.

Referring additionally to FIGS. 2 and 3, in accordance with one embodiment, the headband assembly 104 includes a headband 110 and a bow-shaped arm 112 at each end of the headband assembly 104. An ear-cup 102 is pivotally attached to each arm 112. The headband 110 includes a pair of sliding members 114, each having an extension 115 that can slide internally and relatively to one end of the headband 110. The headband 110 and the pair of sliding members 114 are coupled via a friction-based adjust mechanism, generated by external surfaces of the extensions 115 and corresponding internal surfaces of a channel (not shown) formed internally to the headband 110. Oppositely to the headband 110, each of the arms 112 is attached to a respective one of the sliding members 114.

The friction-based adjust mechanism, provided at both ends of the headband 110, is a mechanism for adjusting the size of the headphone 100 so as to adapt to the size of the wearer's head. To that end, the sliding members 114 are formed so as to create a biasing frictional force when they are slid relatively to the headband 110. Before the headphone 100 is fitted onto the wearer's head, each of the sliding members 114 can be substantially hidden within the corresponding channel. In this position, the distance between each of the headphone units 102 and the apex of the headband 110 is minimal, thus corresponding to the smallest head size that can comfortably accept or wear the headband 110. When the wearer puts on the headphone 100 by holding the earphone units 102 in his/her hands, he/she can adjust the headphone 100 by simply applying a force slightly greater than the frictional forces exerted by the sliding members 114 onto the channel to slide down the earphone units 102 towards his/her ears.

As shown in FIG. 3, in one embodiment the headband assembly 104 includes a folding mechanism 117 for folding the headphone 100 into a closed position when not in use. The folding mechanism 117 allows the arms 112, and their associated ear-cups 102, to be rotated inward to the closed position and housed in the internal space formed by the headband 110. The headphone 100 may be moved to an open position by rotating the arms 112 outward about the folding mechanism 117. In one embodiment, the folding mechanism 117 is a hinge designed to allow rotation of the arms 112 within a predetermined angle of rotation that is defined by the open position and the closed position.

Now referring to FIGS. 4-8, in accordance with one embodiment each of the arms 112 is engaged to a respective one of the ear-cups 102 via a respective one of engagement structures 116. As the connection point between the ear-cups 102 and the arms 112, the engagement structures 116 allow the ear-cups 102 to articulate or rotate in an infinite number of directions about an axis pointing into the head of the user, or approximately parallel to the ear canal. As a result, the engagement structures 116 enable the ear-cups 102 to adjust to any ear shape, thereby increasing the user's comfort-level when wearing the headphone 100.

Figure 7:
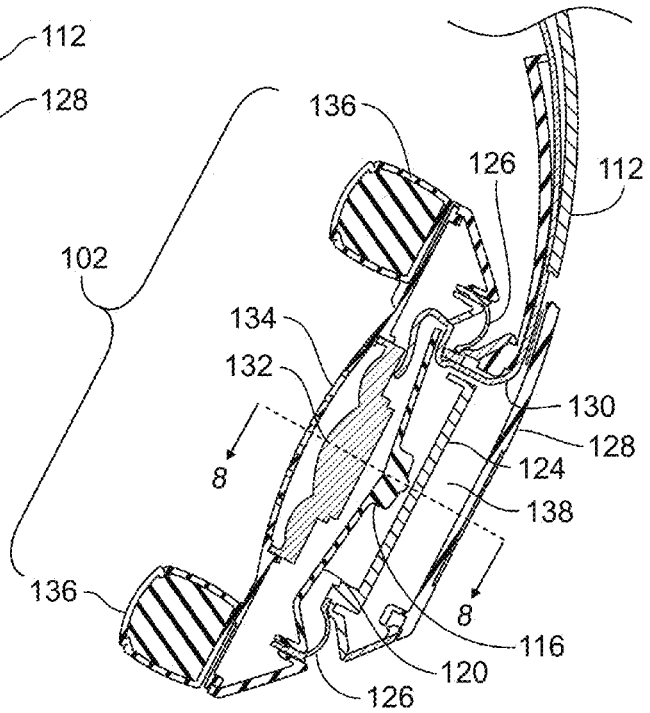
FIG. 7 is a diagram showing a cross-sectional view of the ear-cup of FIG. 6.
Figure 8:
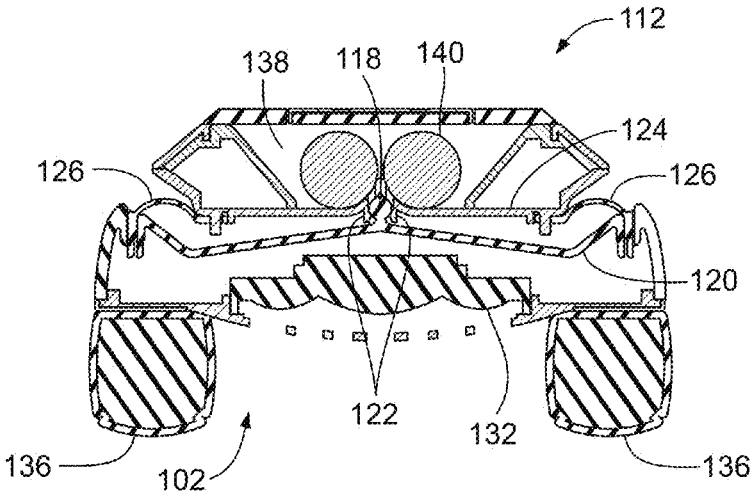
FIG. 8 is a diagram showing a cross-sectional view of the ear-cup of FIG. 7.

As shown in FIGS. 7 and 8, in one embodiment the engagement structures 116 form a ball-and-socket joint to connect the arms 112 and the ear-cups 102. To form the ball-and-socket joint, each engagement structure 116 includes a ball part 118, that is coupled to a ear-cup housing 120 of each of the ear-cups 102, and a socket part 122, that is coupled to an inner housing 124 of each of the arms 112.

The ball part 118 mates with the socket part 122 to pivotably connect the arms 112 and the ear-cups 102. As an example, the ball part 118 may be a substantially spherical ball, and the socket part 122 may be formed by two, longitudinally placed ribs. In another embodiment, the ball part 118 is a circular assembly and the socket part 122 is a circular receptacle for receiving the circular assembly. It is contemplated that one skilled in the art may use other designs for forming the ball-and-socket joint in accordance with the teachings in this disclosure.

Each engagement structure 116 is positioned within and covered by a damper rim 126 to protect the engagement structure 116 from exposure to dust and other foreign particles. By covering the engagement structures 116, damper rims 126 also provide a smooth finish to the headphone 100 by hiding the engagement structures 116 from view. The damper rims 126 also couple the ear-cup 102 to the arms 112 by serving as resilient and flexible connection between the ear-cup housing 120 and the inner housing 124 of the arms 112. The damper rims 126 are positioned vertically, or substantially parallel to an outer cap 128 of the ear-cups 102, and operate to dampen movement of the ear-cups 102 and to generally maintain the position of the ear-cup 102 relative to the arms 112 and the headband 110, without providing undue pressure against the wearer's outer ear. Moreover, due to its slim profile, the damper rims 126 also reduce a thickness of the ear-cups 102, thereby giving the headphone 100 a sleek appearance overall and increasing its aesthetic appeal.

Figure 6:
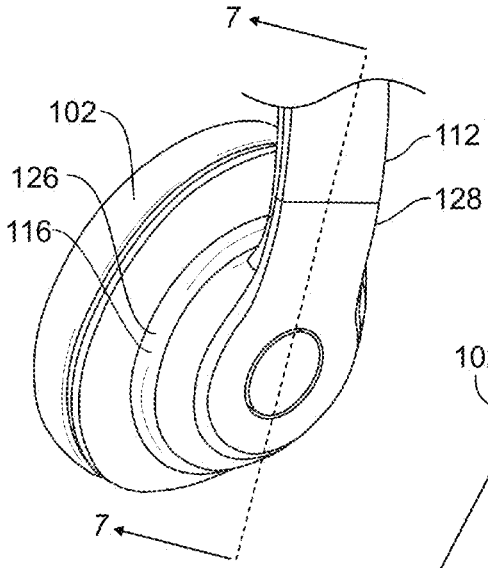
FIG. 6 is a diagram showing a perspective view of an ear-cup of the headphone of FIG. 1.

In one embodiment, the damper rim 126 may be designed as a bellows. Damper rims 126 may be composed of a suitable flexible and resilient material, such as, e.g., rubber or polyester foam. As shown in FIG. 6, for example, the damper rims 126 are visible from an outside view of the ear-cups 102. Damper rims 126 may further have a unique color to bolster the aesthetic appeal of the headphone 100. Also, by adding a color to the damper rims 126, the damper rims 126 are emphasized on the ear-cups 102, so as to visually create or mimic the look of a surround on a traditional speaker cone. For example, damper rims 126 may have a red-color to mimic the look of popular, commercially available red speaker surrounds. This further enhances the aesthetic appeal, and marketing value, of the headphone 100.

In one embodiment, each ear-cup 102 is acoustically enclosed on the back-side by the ear-cup housing 120, except for a small hole to allow routing of a cable 130 that electrically couples each ear-cup 102 to the headphone cable 108 connected to cable port 106. By acoustically sealing the back of each ear-cup 102 with ear-cup housing 120, the sound emitted from the rear of the transducer 132 is confined within each ear-cup 102, thereby enhancing the acoustic characteristics of the headphone 100. Each ear-cup housing 120 includes a transducer 132 for converting electrical signals into sound (for example, electrical signals receiving via the headphone cable 108). In part, transducer 132 produces sound by vibrating and pushing air forward. Ear-cup caps 134 cover each transducer 132 to protect the transducer 132 from the elements, such as dust, small particles, or other contamination. Each ear-cup cap 134 is positioned on a front-side of the ear-cup 102, so as to be directly opposite of the ear-cup housing 120, thereby creating an enclosed space around the transducer 132. The shape and size of this enclosed space determines, in part, the acoustic characteristics of the sound produced by the transducer 132. This enclosed space defines a fixed volume since the ear-cup housing 120 and the ear-cup cap 134 are relatively rigid components, i.e. not composed of flexible materials that significantly expand or contract when pressure is applied. The transducer 132 may be acoustically configured to produce optimal sound within the fixed volume formed by the enclosed space. As will be appreciated, internal sound reflections within the ear-cup housing 120 can degrade sound quality by producing standing waves and other forms of sound diffraction. To address these and other known issues, the ear-cup housing 120 may contain absorptive materials (e.g., wool, synthetic fiber batting, etc.) within the fixed volume (e.g., loosely packed within the enclosed space or densely lining the walls of the enclosed space), and/or the internal shape of the space enclosed within each ear-cup 102 may be designed to reflect sounds away from the ear-cup cap 134, where they may then be absorbed. Each ear-cup cap 134 may include a specifically designed grid-like surface for enabling sound to radiate from the transducer 132 towards the user's ear. In one embodiment, the grid-like surface of the ear-cup cap 134 may be comprised of a wire or fabric mesh.

According to other embodiments, each ear-cup 102 may include one or more vents in a front and/or back of the ear-cup 102. Like ports, vents can assist with frequency response tuning or adjustment. However, unlike ports, which are typically tube-like structures that occupy a larger volume, vents are very thin openings in the housing 120 of the ear-cup and typically have a thickness equal to a thickness of the ear-cup housing 120 (e.g., about 1.5 mm). In one embodiment, the ear-cup 102 includes back vents that are configured to tune a response of the transducer 132 by allowing a measured amount of sound leakage out of the back of the ear-cup 102. According to one aspect, the ear-cups 102 may include a mesh comprised of acoustically resistive material (e.g., a foam, a thin, perforated sheet, mesh, etc.) that is placed over the back vents to provide an appropriate amount of leakage. In one embodiment, the ear-cup 102 also includes front vents, which are configured to be more resistive than the back vents. For example, the front vents may be designed to allow less sound leakage at higher frequencies and more sound leakage at lower frequencies.

Additionally, or in the alternative, in some embodiments, the ear-cup 102 may include front vents and back vents in order to protect against an application of excessive pressure to the ear-cups 102. For example, if the user presses the ear-cup 102 too hard, it can damage a diaphragm of the transducer 132 by causing the diaphragm to become crinkled or puckered. Such excessive pressure can happen inadvertently while wearing the headphone 100, for example, if the ear-cup is pressed too hard against the head of the user. By providing front and back vents in the ear-cup 102, the acoustic chamber within the ear-cup 102 may not be fully-enclosed (e.g., may not be in a vacuum) and as a result, any pressure applied to the ear-cup 100 can be relieved through the vents of the ear-cup 102. For example, the front and back vents may operate as a pressure-relief valve within the ear-cup 102 that helps prevent damage to the diaphragm of the transducer 132, as well as other components within the ear-cup 102.

Cushioning doughnut-shaped ear pads 136 are wrapped circumferentially around the sound-radiating side of each ear-cup 102 for providing comfortable positioning on the user's ear. Due to the flexibility provided by the engagement structures 116 and the bow shape of the arm 112, when the headphone 100 is mounted on the wearer's head, each of the ear-cups 102 is completely self-adjustable with respect to the wearer's ear to become substantially parallel to the ear, thereby adopting an optimum position which minimizes the travel of the sound outside the ear pad 136. As such, the cushioned ear-cups 102 provide very comfortable listening, superior passive sound isolation, and minimize ear fatigue due to extended wear.

Figure 9:
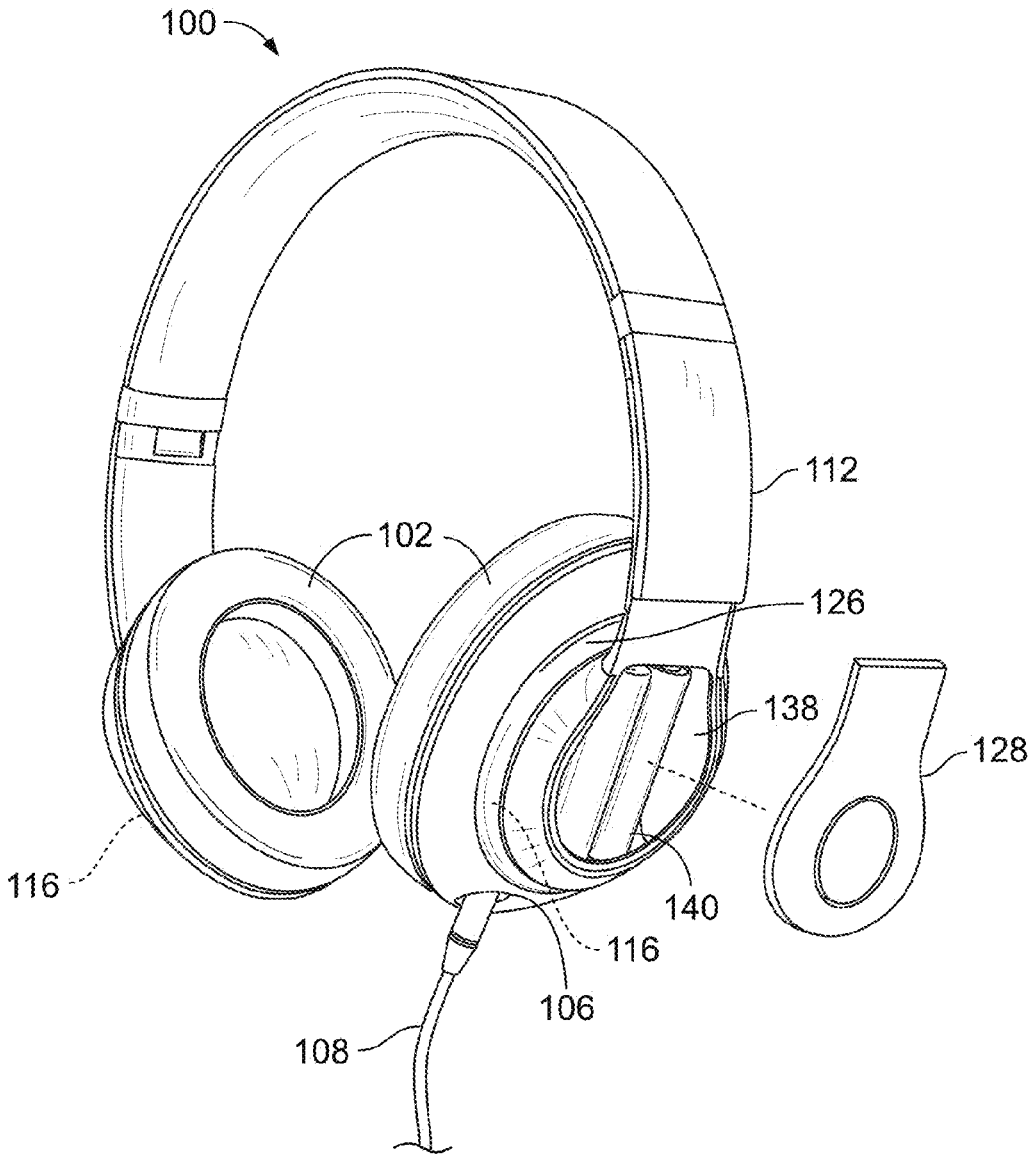
FIG. 9 is a diagram showing a perspective view of the headphone of FIG. 1 with the outer cap removed.

Referring additionally to FIG. 9, in some embodiments, a cavity 138 may be formed in at least one of the arms 112 between the outer cap 128 and the inner housing 124. The cavity 138 may provide a space, e.g., battery compartment, that houses one or more batteries 140 for providing power to the headphone 100 and a printed circuit board (PCB) (not shown) that controls the provision of battery power to the headphone 100. FIG. 9 shows an embodiment in which the two batteries are required to power the headphone 100, and the cavity 138 is accordingly shaped and designed to accept two batteries. The disclosure is not limited to the illustrated configuration, and other types and/or quantities of batteries may be used in accordance with the teachings herein. By designing the arms 112 of the headphone 100 to include the cavity 138 for batteries 140, valuable space is saved, and the overall bulk of the headphone 100 is reduced.

Figure 10:
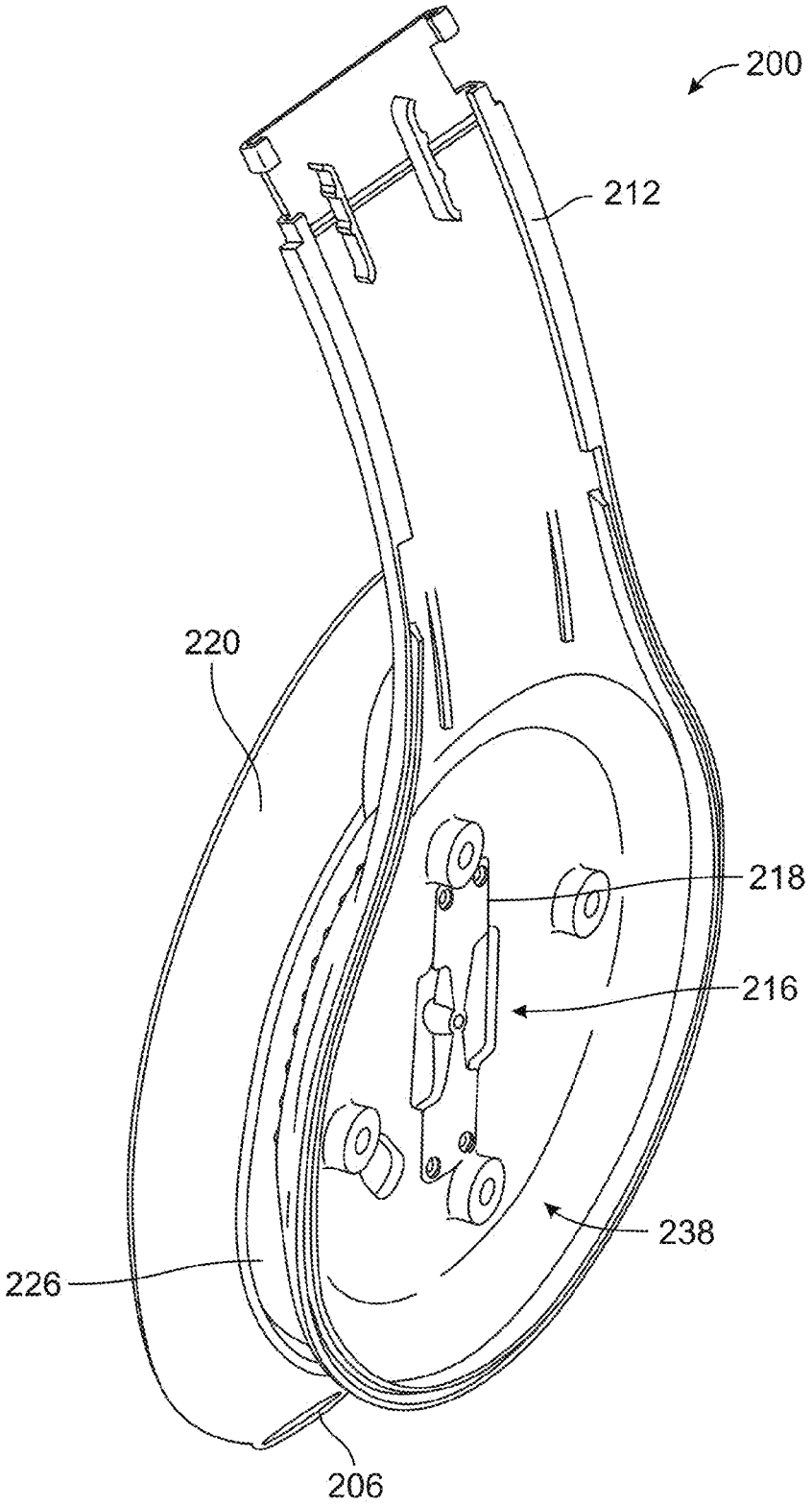
FIG. 10 is a diagram showing a perspective view of a portion of a headphone in accordance with an embodiment.
Figure 11:
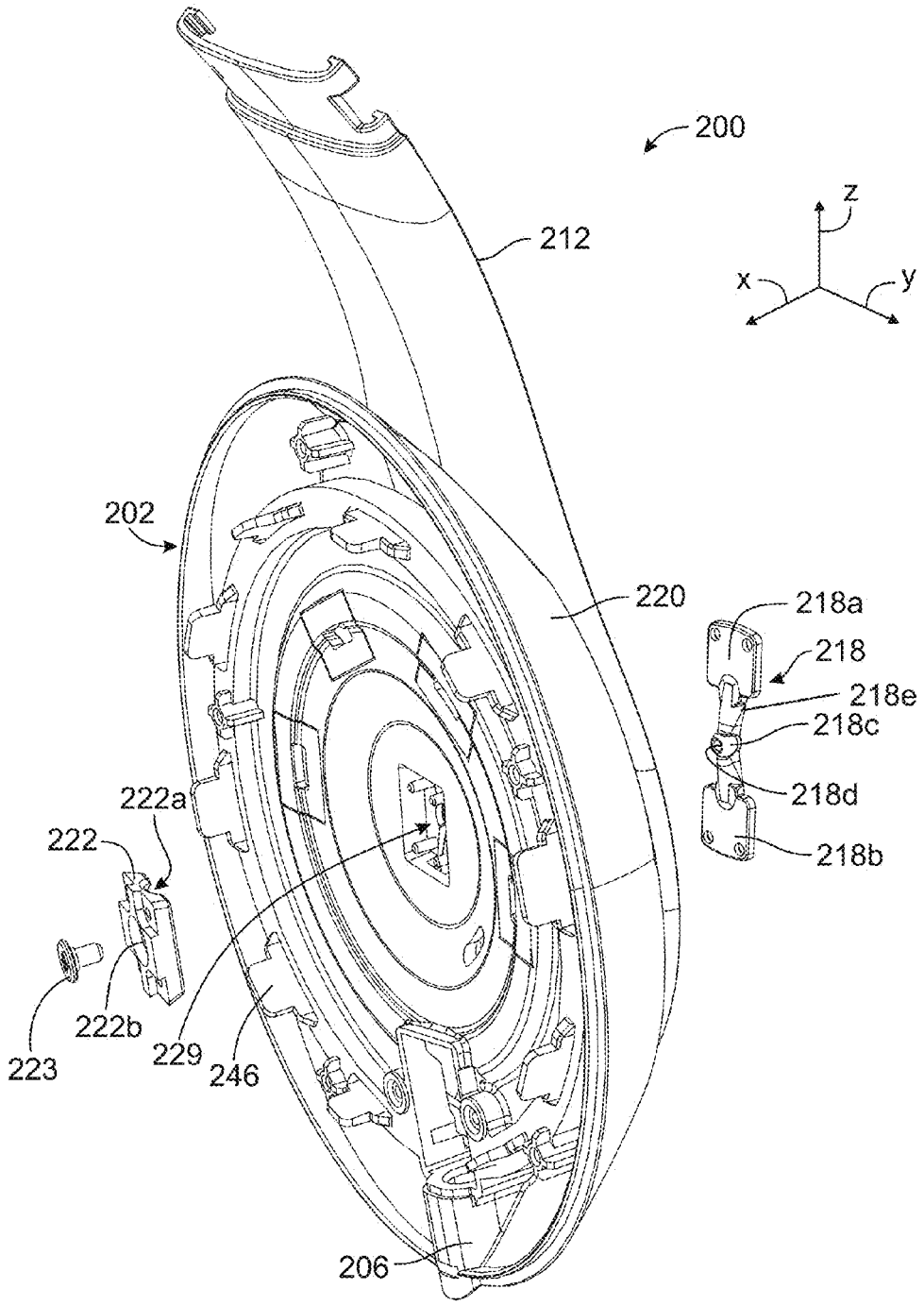
FIG. 11 is a diagram showing an opposing perspective view of the headphone portion of FIG. 10 and an exploded view of a set of engagement structures included in the headphone portion.
Figure 12:
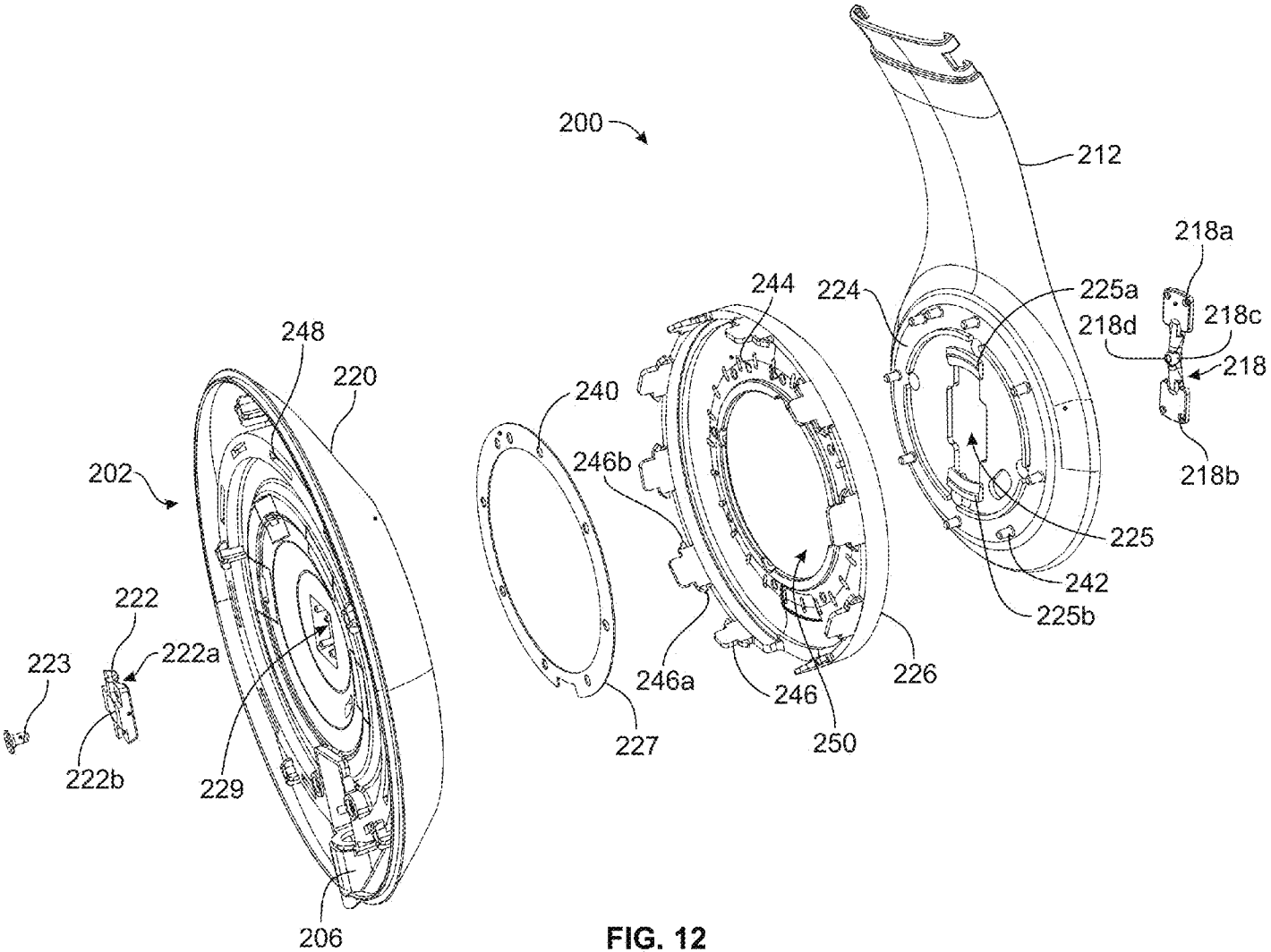
FIG. 12 is a diagram showing a further exploded view of the headphone portion shown in FIG. 11.
Figure 13A:
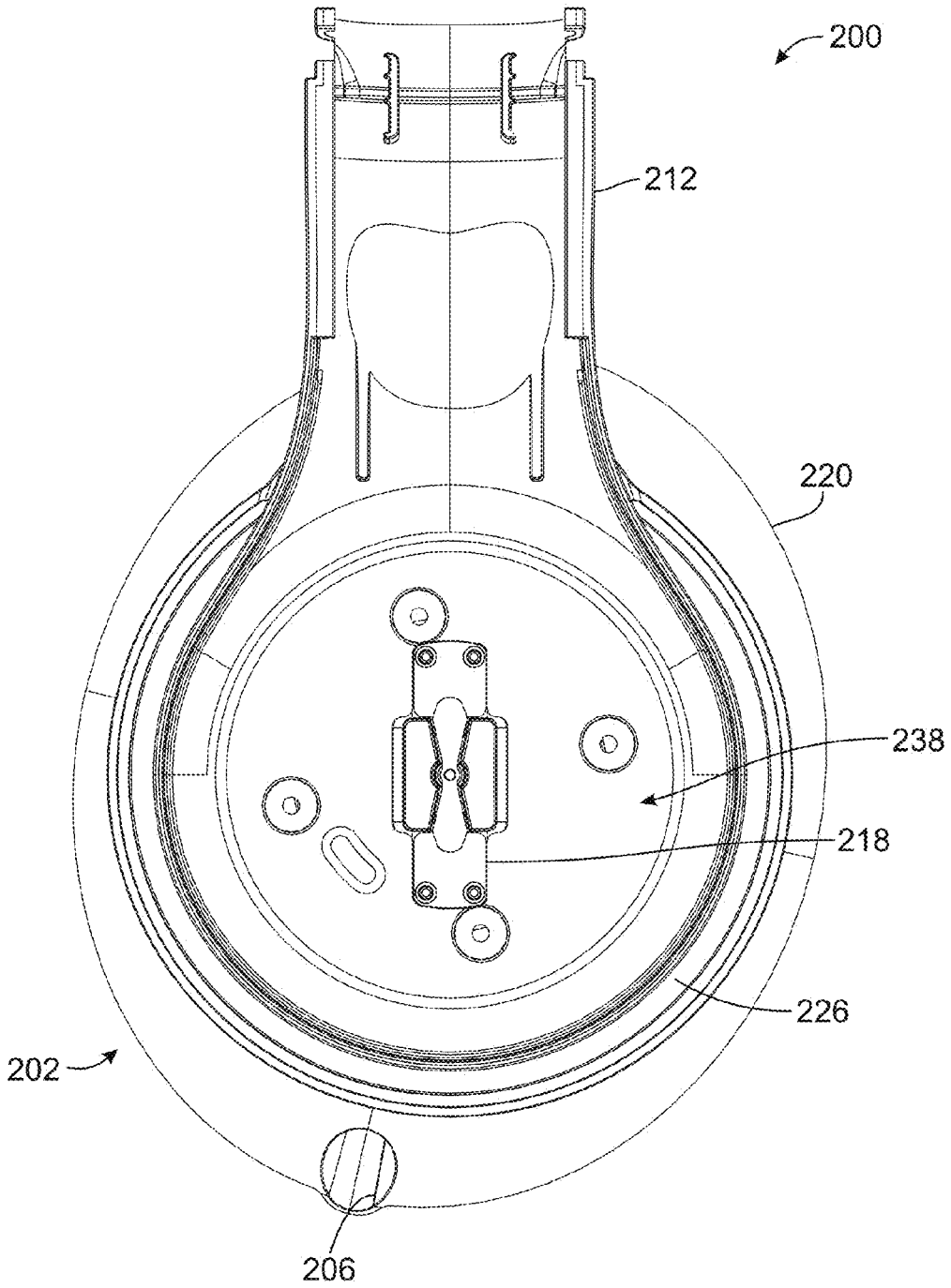
FIG. 13A is a diagram showing a side view of the headphone portion of FIG. 10.
Figure 13B:
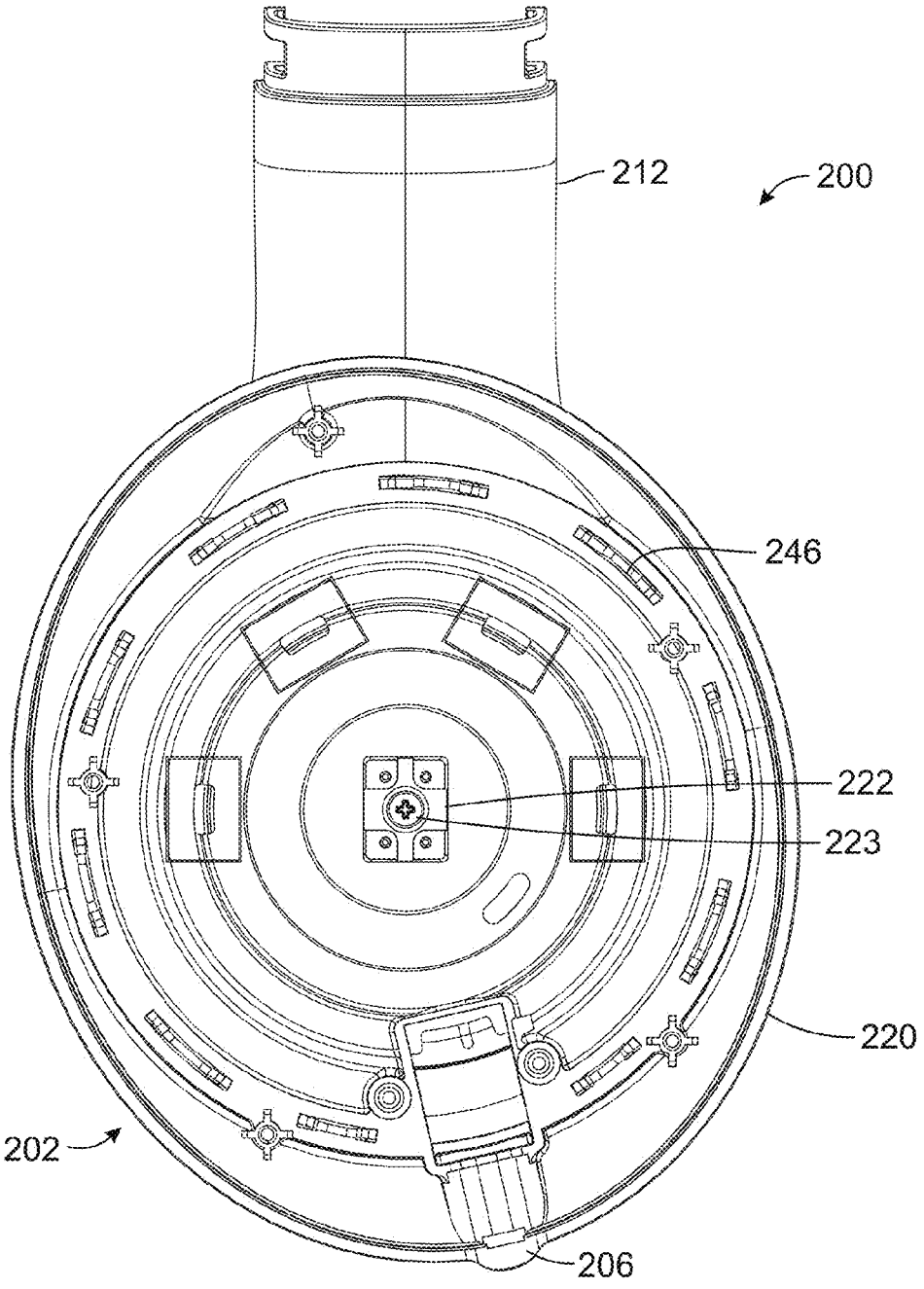
FIG. 13B is a diagram showing an opposing side view of the headphone portion of FIG. 10.

FIGS. 10-14 illustrate different views of an audio listening device 200 (or, more simply, "headphone") according to one embodiment. FIG. 10 is a perspective view of an outer side of a portion of the headphone 200. FIG. 11 is a perspective view of an inner side of the headphone portion shown in FIG. 10. FIG. 12 is an exploded perspective view of the portion of the headphone 200 shown in FIG. 11. FIG. 13A is an outer side view of the headphone portion shown in FIG. 11. FIG. 13B is an inner side view of the headphone portion shown in FIG. 13A. FIG. 14A is a perspective view of the portion of the headphone shown in FIG. 11. And FIG. 14B is a cross-sectional view of a segment of the headphone portion shown in FIG. 14A.

The headphone 200 may include components that are similar to those included in the headphone 100. For example, the headphone 200 may include a pair of ear-cups 202, a cable port 206, and/or a pair of bow-shaped arms 212 that are substantially similar to the ear-cups 102, cable port 106, and arms 112 shown in FIG. 1. The ear-cups 202 may include an ear-cup housing 220, similar to the ear-cup housing 120. The headphone portion illustrated in FIGS. 10-14 may be part of, for example, a left-ear unit and/or a right-ear unit of the headphone 200 and may be attached to a headband (such as, e.g., headband 110) of the headphone 200. For example, a top of each arm 212 may be coupled to the headband via extendible sliding members (such as, e.g., sliding members 114).

As illustrated, the headphone 200 may include an engagement structure 216 (also referred to herein as "a set of engagement structures 216) configured to pivotably couple each of the arms 212 to a respective one of the ear-cups 202. According to one embodiment, the engagement structure 216 may include a pair of cooperatively-coupled curved surfaces between the ear-cup 202 and the arm 212, the curved surfaces defining a ball-joint type of interface configured to allow rotation of the ear-cup 202 relative to the arm 212. In FIGS. 10 and 13, an outer cover of the arm 212 (such as, e.g., the outer cap 128 shown in FIG. 9), and any other components included within a cavity 238 of the arm 212, have been removed in order to show the engagement structure 216 included therein. Similarly, in FIGS. 11, 12, and 14, portions of the ear-cup 202 have been removed in order to show the assembly of the engagement structure 216. For example, the ear-cup 202 may include a transducer (such as, e.g., the transducer 132), an ear-cup cap (such as, e.g., the ear-cup cap 134), and ear pads (such as, e.g., the ear pads 136), none of which are shown in the illustrated embodiment.

As shown in FIG. 11, in some embodiments, the engagement structure 216 can include a rear plate 218 (also referred to herein as a first plate), a front plate 222 (also referred to herein as a second plate), and a screw 223 that is configured to couple the front plate 222 to the rear plate 218. Each of the rear plate 218, the front plate 222, and the screw 223 may be made of metal (e.g., zinc), plastic, and/or any other suitable material.

According to one embodiment, the rear plate 218 may be positioned proximate to or within the cavity 238 of the arm 212. The arm 212 may include an inner housing 224 that is opposite from the cavity 238 and has an opening 225 configured to receive at least a portion of the rear plate 218. In some embodiments, the opening 225 may be configured to prevent the entire rear plate 218 from passing through the opening 225. For example, a top portion 218*a* of the rear plate 218 may press against a top portion 225*a* of the opening 225 and a bottom portion 218*b* of the rear plate 218*b*. The top and bottom portions of the rear plate 218 may include flat, paddle-shaped portions that are configured to lie flat against respective portions of the opening 225. The rear plate 218 may further include a curved convex surface 218*c*, that is at least partially semi-spherical or rounded. In one embodiment, the curved convex surface 218*c* may be positioned in a center of the rear plate 218. In one embodiment, the curved convex surface 218*c* may extend or jut out beyond the paddle-shaped portions 218*a* and 218*b*, such that an inclined portion 218*e* is formed from a top side of the curved convex surface 218*c* to either of the paddle-shaped portions 218*a* and 218*b*, as can be seen in FIG. 11. As a result, when attached to the front plate 222, the curved convex portion 218*c* of the rear plate 218 may extend at least partially into the opening 225 of the inner housing 224, while the paddle-shaped portions 218*a* and 218*b* remain behind the inner housing 224. As shown in FIG. 11, the inclined portion 218 may be at least slighted curved or rounded.

According to one embodiment, the front plate 222 may be positioned proximate to the ear-cup housing 220. Specifically, the ear-cup housing 220 may include an opening 229 that is configured to at least partially receive the front plate 222. In some embodiments, the opening 229 may have dimensions that are substantially similar to the dimensions of the front plate 222, such that the front plate 222 fits snugly into the opening 229. The front plate 222 may include a curved concave surface 222*a* configured to cooperatively receive and contact the curved convex surface 218*c*, upon attachment of the front plate 222 to the rear plate 218.

As shown in FIG. 11, the front plate 222 may include an aperture or bore 222*b* configured to receive the screw 223. Likewise, the rear plate 218 may include an aperture or bore 218*d* configured to receive the screw 223. According to one embodiment, the screw 223 passes through both the aperture 222*b* in the front plate 222 and the aperture 218*d* in the rear plate 218 in order to secure the ear-cup 202 to the arm 212. In some embodiments, the screw 223 may secured to the apertures 222*b* and 218*d* using any of a number of engagement means including, for example, threaded fastening, riveted fastening, heat-staked fastening, etc. In one embodiment, the screw 223 may be a shoulder screw that provides a slight gap between a bottom side of a head of the screw 223 and a surface of the front plate 222 to which the screw 223 is being secured. According to one aspect, this slight gap between the screw 223 and the front plate 222 may provide the freedom to at least slightly move or angle the front plate 222 relative to the rear plate 218 and thereby, cause (at least slight) rotation of the ear-cup 202 relative to the arms 212 (or vice versa). In one embodiment, this rotation, which is described in more detail below with respect to FIGS. 16 and 17, may be sufficient to adjust the ear-cups 202 over the ears of the user into a more comfortable, flexible fit.

Figure 15B:
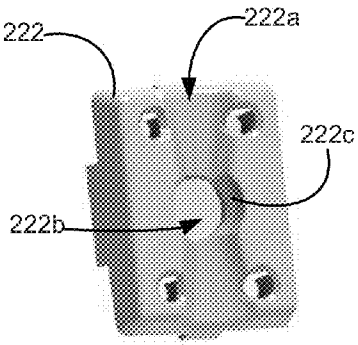
FIG. 15B is a diagram showing a perspective view of the portion of the set of engagement structures of FIG. 15A.
Figure 15A:
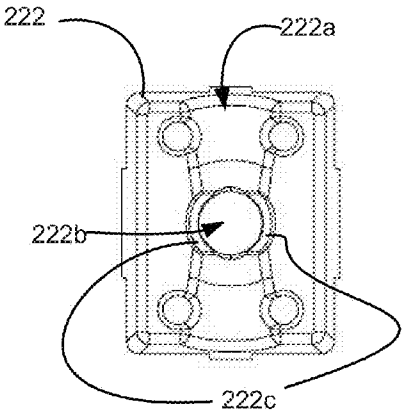
FIG. 15A is a diagram showing a front view of a portion of a set of engagement structures in accordance with some embodiments.

Referring now to FIGS. 15A and 15B, shown are a front view and a perspective view of a face of the front plate 222, respectively. In some embodiments, the curved concave surface 222*a* of the front plate 222 may include a curved concave channel that extends a height of the front plate 222 (e.g., from top to bottom). In one embodiment, a curvature of the curved concave channel may be configured to receive and/or allow movement of the rounded inclined portion 218*e* of the rear plate 218 during rotation of the engagement structures 216, as can be seen in FIGS. 16 and 17. Moreover, as seen in the illustrated embodiment of FIG. 15, the curved concave surface 222*a* may further include curved sidewalls 222*c* on either side of the aperture 222*b*. In one embodiment, a curvature of the curved sidewalls 222*c* may be configured to receive and/or allow movement of the curved convex surface 218*c* of the rear plate 218 during rotation of the engagement structures 216.

Referring now to FIGS. 16 and 17, shown are perspective, side, and/or end views of the engagement structure 216 in various rotational positions that are achieved by moving or rotating the ear-cup 202 relative to the arm 212 (or vice versa). As can be seen in FIGS. 16 and 17, the curved concave surface 222*a* and the curved sidewalls 222*c* of the front plate 222 may be configured to fit over, or be cooperatively coupled to, the rounded inclined portions 218*e* and the curved convex surface 218*c* of the rear plate 218, respectively, to form an interface. However, the engagement structure 216 may be configured to leave enough space between the front plate 222 and the rear plate 218 to allow a certain degree of movement there between (e.g., due to space around or under the head of the screw 223) as shown in FIGS. 16 and 17. In some embodiments, the engagement structure 216 may be capable of rotational positions other than, or in addition to, the positions illustrated in FIGS. 16 and 17. According to one embodiment, the engagement structure 216 may be configured for limited rotation in any and/or all directions about the interface between the rear plate 218 and the front plate 222, but without twisting or spinning in a complete circle (e.g., 360 degree) around the interface. In one embodiment, the engagement structure 216 may be configured for five to ten degrees of rotation in each direction about the interface between the rear plate 218 and the front plate 222. In one exemplary embodiment, the engagement structure 216 may be configured for at least seven and a half degrees of rotation in each direction about the interface between the rear plate 218 and the front plate 222.

Figure 17C:
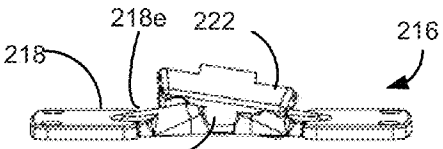
FIGS. 17A through 17C illustrate side views of different rotational positions of a set of engagement structures in accordance with some embodiments.
Figure 17F:
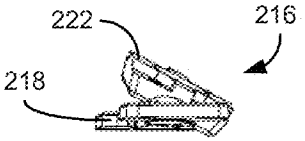
FIGS. 17D through 17F illustrate end views of different rotational positions of a set of engagement structures in accordance with some embodiments.
Figure 17B:
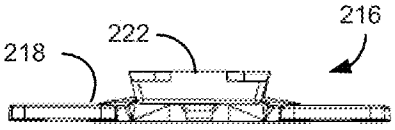
Figure 17E:
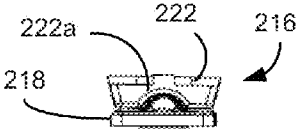
Figure 17A:
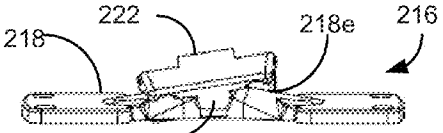
Figure 16A:
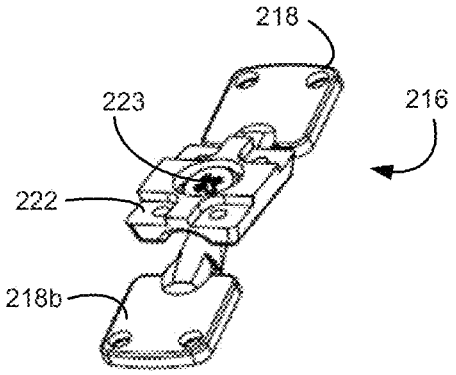
FIGS. 16A through 16E illustrate perspective views of different rotational positions of a set of engagement structures in accordance with some embodiments.
Figure 16B:
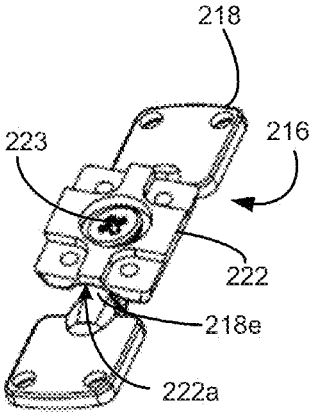
Figure 16C:
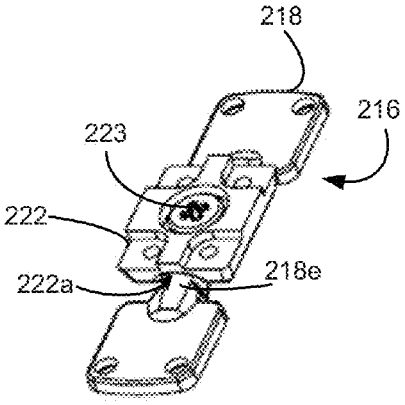
Figure 16D:
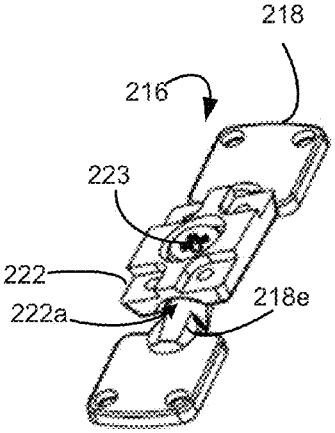
Figure 16E:
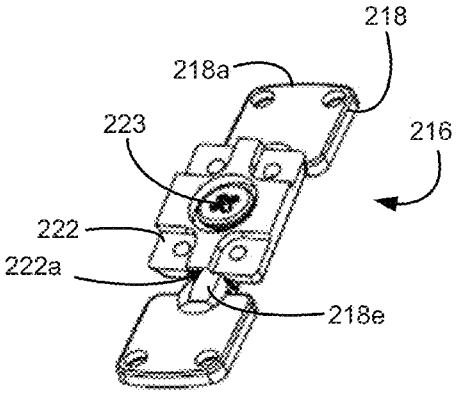

To provide a reference point, FIG. 16C illustrates a perspective view of the the engagement structure 216 in a neutral position, FIG. 17B illustrates a side view of the engagement structure 216 in the neutral position, and FIG. 17E illustrates an end view of the engagement structure 216 in the neutral position. According to one aspect, FIG. 16A illustrates a perspective view of the engagement structure 216 in a first rotational position, wherein the front plate 222 is tilted downwards, (e.g., towards the lower paddle portion 218*b*), and FIG. 17A may represent a side view of the first rotational position. As an example, the first rotational position may be achieved by tilting or slanting the ear-cup 202 downwards, so as to increase a space between a top of the ear-cup 202 and an upper portion of the arm 212 that is adjacent to the top of the ear-cup 202. According to one aspect, FIG. 16E illustrates a perspective view of the engagement structure 216 in a second rotational position, wherein the front plate 222 is titled upwards (e.g., towards the upper paddle portion 218*a*), and FIG. 17C may represent a side view of the second rotational position. As an example, the second rotational position may be achieved by tilting or slanting the ear-cup 2902 upwards, so as to increase a space between a bottom of the ear-cup 202 and a lower portion of the arm 212 that is adjacent to the bottom of the ear-cup 202. As can be seen in FIGS. 16A, 16E, 17A, and 17C, the first rotational position and the second rotational position may move the front plate 222 in opposing directions relative to a central point (e.g., the screw 223).

Figure 17D:
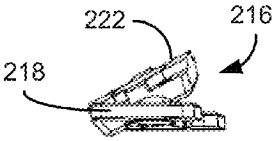

According to one aspect, FIG. 16B illustrates a perspective view of the engagement structure 216 in a third rotational position, wherein the front plate 222 is tilted towards a left side of the engagement structure 216, and FIG. 17D represents an end view of the third rotational position. As an example, the third rotational position may be achieved by turning or tilting the ear-cup 202 towards a left side of the arm 212, so as to increase a space between a right side of the ear-cup 202 and a right side of the arm 212. According to one aspect, FIG. 16D illustrates a perspective view of the engagement structure 216 in a fourth rotational position, wherein the front plate 222 is tilted towards a right side of the engagement structure 216, and FIG. 17F may represent an end view of the fourth rotational position. As an example, the fourth rotational position can be achieved by turning or tilting the ear-cup 202 towards a right side of the arm 212, so as to increase a space between a left side of the ear-cup 202 and a left side of the arm 212. As can be seen in FIGS. 16B, 16D, 17D, and 17F, the third rotational position and the fourth rotational position may move the front plate 222 in opposing directions relative to a central point (e.g., the screw). In one embodiment, either of the rear plate 218 and the front plate 222 may be rotated or moved relative to each other. For example, in the above examples from FIGS. 16 and 17, any of the first, second, third, and/or fourth rotational positions may also be achieved by moving the rear plate 218 relative to the front plate 222, rather than, or in addition to, moving the front plate 222 relative to the rear plate 218.

The headphone 200 may also include a damper or damper rim 226 that is at least similar in function to the above-described damper rim 126. For example, the damper 226 may cover and protect the engagement structure 216 from exposure to dust and other foreign particles. In addition, the damper 226 may serve as a resilient and flexible connection between the ear-cup housing 220 and the inner housing 224 of the arm 212. In some embodiments, the damper 226 may also be configured to constrict or dampen movement between the ear-cup 202 and the arm 212. For example, the damper 226 may be configured to have sufficient resilience and flexibility to allow semi-free rotation of the ear-cup 202, but still generally maintain or retain the position of the ear-cup 202 relative to the arm 212 (e.g., force the ear-cup back to a neutral position), without providing undue pressure against a headphone wearer's outer ear. According to some embodiments, the damper 226 may be made of rubber (e.g., silicon), plastic, or any other flexible and resilient material. In addition, the presence of the damper 226 between the ear-cup 220 and the arm 212 helps to stabilize the ear-cup 202 and at least partially dampen excessive forces that, for example, can dislodge internal components and thereby cause a "rattling" noise in the headphone. In one embodiment, the presence of the damper 226 has virtually eliminated the rattling noise within the headphone 200.

According to some embodiments, the damper 226 may be attached to the arm 212 using a first attachment mechanism and may be attached to the ear-cup housing 212 using a second attachment mechanism. By using two different attachment mechanisms for attaching the damper 226, the ear-cup 202 may be provided with a wider range of motion and/or greater flexibility. As will be appreciated, though specific examples of damper attachment mechanisms may be provided, the principles disclosed herein are not limited to the exact structures described and shown herein.

In some embodiments, the first attachment mechanism may include a ring-shaped clamp 227 for coupling the damper 226 to the arm 212. The ring-shaped clamp 227 includes a plurality of apertures 240 that are configured to receive a plurality of prongs 242 included in the inner housing 224. Likewise, the damper 226 may include a plurality of apertures 244 that are configured to fit over the prongs 242. According to one embodiment, the prongs 242 may be heat staked to the clamp 240 and the damper 226 in order to create a secure, permanent connection between the components. According to some embodiments, the clamp 240 may be made of metal, plastic, or any other suitable material.

In some embodiments, the second attachment mechanism for securing the damper 226 to the ear-cup housing 220 may include a plurality of tabs 246 coupled to the damper rim 226 and a plurality of slots 248 configured to receive the tabs 246. According to one embodiment, the tabs 246 may snap into the slots 248. For example, each of the tabs 246 may include flexible flanges 246*a* and 246*b* on either side of the tab 246. The flexible flanges 246*a* and 246*b* may include a spring mechanism that allows the flanges 246*a* and 246*b* to be pressed substantially flat during insertion into the slot 248, in order to allow the tab 246 to pass through the slot 248. Once the tab 246 passes through the slot 248, the flanges 246*a* and 246*b* may automatically re-extend, or spring back into place, so that the tab 248 cannot be pulled back through the slot 248 (e.g., because a length of the fully-extended tab 246 is greater than a length of the slot 248).

Figure 14A:
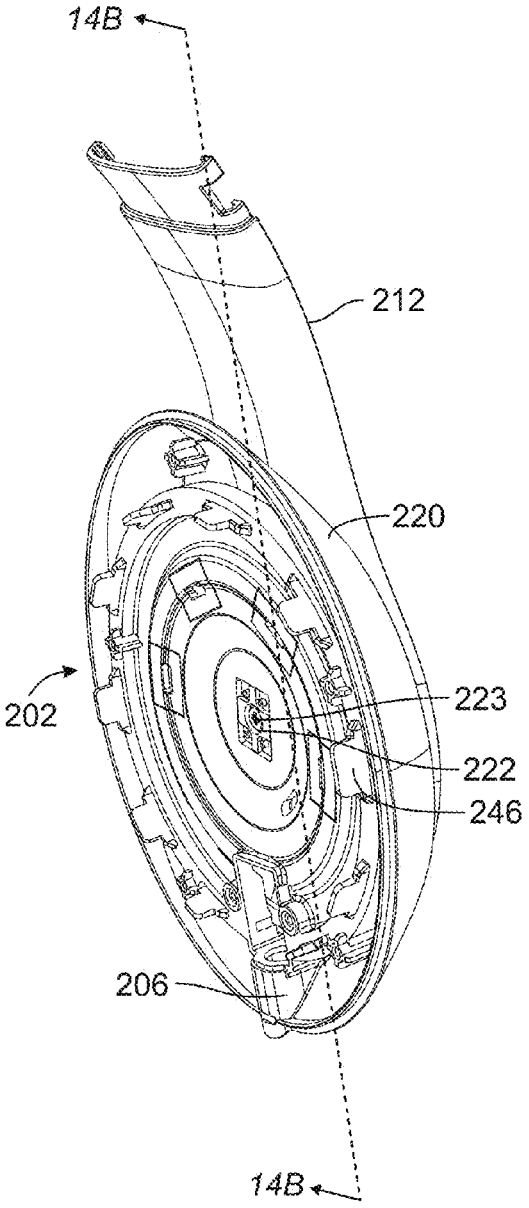
FIG. 14A is a diagram showing a perspective view of the headphone portion of FIG. 11.
Figure 14B:
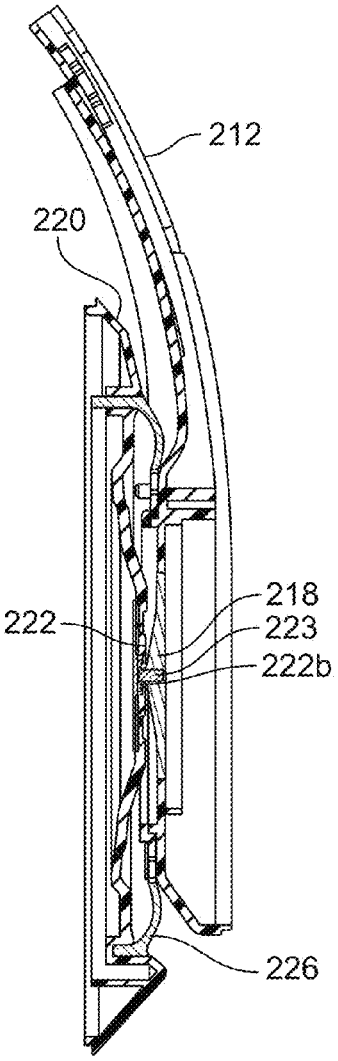
FIG. 14B is a diagram showing a cross-sectional view of the headphone portion of FIG. 14A.

According to some embodiments, though the damper 226 is positioned between the ear-cup 202 and the arms 212, the actual point of connection between the ear-cup 202 and the arms 212 may be comprised only of the engagement structure 216. As shown in FIG. 12, the damper 226 may include an aperture 250 having a diameter that is larger than the engagement structure 216, and the diameter of the aperture 250 may be larger than a height of the rear plate 218. As a result, the engagement structure 216 may pass through, or be positioned within, the aperture 250 of the damper 226 without contacting the damper 226. As shown in FIG. 14B, while the screw 223 secures or couples the rear plate 218 and the front plate 222 together, and thereby effectively attaches the ear-cup housing 220 to the arm 212, the curved convex portion 218*c* of the rear plate 218 and the curved concave portion 222*a* of the front plate 222 may serve as the actual, functional interface (e.g., similar to a ball joint) between the ear-cup housing 220 and the arm 212.

As discussed above, the curved surfaces of the engagement structure 216 enable the ear-cup 202 to pivot relative to the arm 212 in any direction about the interface formed by the front plate 222 and the rear plate 218. To some extent, the damper 226 may be configured to constrict this movement of the ear-cup 202 relative to the arm 212, at least because unconstricted movement of the ear-cup 202 can cause undesirable effects, such as, e.g., hanging or tilting down of the ear-cup 202 and/or rattling noise within the ear-cup 202.

As will be appreciated, the principles described herein are not limited to the exact structure, shape, or size depicted in the figures. For example, instead of paddle-shaped portions 218*a* and 218*b*, the rear plate 218 can have any other overall shape that provides a curved or semi-spherical interface between the ear-cup 202 and the arm 212.

Thus, the headphones disclosed herein provide sleek, space-saving audio listening devices that can be comfortably worn by the wearer for an extended listening period, when compared to commercially available headphones. By pivotably connecting the ear-cups to the arms using the disclosed engagement mechanisms, and dampening the movement of the engagement mechanisms with a flexible damper rim, a comfortable, substantially pressureless, and precise fitting solution to the wearer's ear is achieved, while protecting the ear-cups from excessive forces and/or movements that can lead to rattling noises within the ear-cups. Furthermore, as discussed above, several features are provided to obtain a slimmer and sleeker design with convenient portability. For example, the damper rims not only provide a protective cover for the engagement mechanisms, but also provide an element of aesthetic appeal by mimicking the look, and color, of a traditional speaker cone surround. Moreover, the size and positioning of the damper rims and the placement of batteries in the arms reduces the overall thickness of the ear-cups, thereby increasing the commercial appeal and usability of the headphone disclosed herein.

It should be emphasized that the above-described embodiments, particularly, any "preferred" embodiments, are possible examples of implementations, merely set forth for a clear understanding of the principles of the invention. Many variations and modifications may be made to the above-described embodiment(s) of the invention without substantially departing from the spirit and principles of the invention. All such modifications are intended to be included herein within the scope of this disclosure and protected by the following claims.

What is claimed is:

1. An audio listening device, comprising:

a headband assembly comprising at least one end;

an ear-cup assembly pivotably engaged to the at least one end of the headband assembly by an engagement structure, the engagement structure comprising at least two cooperatively-coupled curved surfaces; and an annular damper rim coupled to the ear-cup assembly and to the at least one end of the headband assembly, wherein the damper rim is configured to at least partially constrict movement of the ear-cup assembly relative to the headband assembly, wherein an outer radius of the damper rim is spaced apart from the at least one end of the headband assembly.

2. The audio listening device of claim 1, wherein the at least two curved surfaces of the engagement structure define a ball joint type interface between the ear-cup assembly and the headband assembly.

3. The audio listening device of claim 1, wherein the ear-cup assembly is capable of between five and eight degrees of rotational movement about an interface formed by the at least two curved surfaces.

4. The audio listening device of claim 1, wherein the engagement structure includes a first plate, the first plate comprising a curved convex surface.

5. The audio listening device of claim 4, wherein the engagement structure further includes a second plate, the second plate comprising a curved concave surface.

6. The audio listening device of claim 5, wherein the engagement structure further includes an attachment mechanism for attaching the first plate to the second plate.

7. The audio listening device of claim 6, wherein each of the first plate and the second plate includes an aperture configured to receive the attachment mechanism for attachment thereto.

8. The audio listening device of claim 5, wherein the curved convex surface of the first plate is cooperatively coupled to the curved concave surface of the second plate to form an interface.

9. The audio listening device of claim 5, wherein the first plate is positioned proximate to the at least one end of the headband assembly and the second plate is positioned proximate to a center of the ear-cup assembly.

10. The audio listening device of claim 1, wherein the damper rim is coupled to the headband assembly using a first attachment mechanism and the damper rim is coupled to the ear-cup assembly using a second attachment mechanism.

11. The audio listening device of claim 1, wherein the damper rim includes an aperture having a diameter that is larger than the engagement structure.

12. The audio listening device of claim 11, wherein the engagement structure is positioned within the aperture of the damper rim.

13. The audio listening device of claim 1, wherein the damper rim is composed of rubber.

14. The audio listening device of claim 4, wherein the first plate further comprises opposed paddle-shaped portions positioned laterally outwardly of the curved convex surface.

15. The audio listening device of claim 9, wherein the headband assembly defines an inner concave region, wherein the at least one end of the headband assembly defines an aperture sized to prevent the first plate from passing therethrough, and wherein the first plate is positioned opposite the inner concave region relative to the aperture.

16. An audio listening device, comprising:

a headband assembly defining at least one end having an inner housing and an open chamber, the inner housing defining a corresponding aperture opening to the open chamber;

an ear-cup assembly having an ear-cup housing defining a corresponding aperture;

an annular damper rim positioned between the ear-cup housing and the inner housing of the at least one end of the headband assembly; and, an engagement structure pivotably coupling the ear-cup housing with the at least one end of the headband assembly, wherein the engagement structure comprises a first plate defining a curved surface cooperatively coupled with a curved surface of a second plate to permit pivotable movement therebetween, the first plate being larger in at least one dimension than the aperture defined by the inner housing to prevent the first plate from passing therethrough, and the second plate being sized to matingly engage with the aperture of the ear-cup assembly.

17. An audio listening device according to claim 16, wherein the damper rim is configured to at least partially constrict movement of the ear-cup assembly relative to the headband assembly.

18. An audio listening device according to claim 16, wherein a fastener extends through the first plate and the second plate, pivotably engaging the first plate and the second plate to each other.

19. An audio listening device according to claim 16, wherein first plate defines opposed paddle-shaped portions and an inner portion extending therebetween, wherein the inner portion defines the curved surface of the first plate.

20. An audio listening device according to claim 19, wherein the curved surface of the first plate comprises a convex surface, wherein the second plate defines a concave channel slidably receiving the convex surface of the first plate.

* * * * *